US010355383B2

(12) United States Patent
Consoli et al.

(10) Patent No.: US 10,355,383 B2
(45) Date of Patent: Jul. 16, 2019

(54) CIRCUIT CARD ASSEMBLIES FOR A COMMUNICATION SYSTEM

(71) Applicant: TE CONNECTIVITY CORPORATION, Berwyn, PA (US)

(72) Inventors: John Joseph Consoli, Harrisburg, PA (US); Chad William Morgan, Carneys Point, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/456,785

(22) Filed: Mar. 13, 2017

(65) Prior Publication Data

US 2018/0261941 A1 Sep. 13, 2018

(51) Int. Cl.

| | |
|---|---|
| ***H01R 12/00*** | (2006.01) |
| ***H01R 12/73*** | (2011.01) |
| ***H01R 12/72*** | (2011.01) |
| ***H01R 12/71*** | (2011.01) |

(52) U.S. Cl.
CPC ..... *H01R 12/737* (2013.01); *H01R 12/712* (2013.01); *H01R 12/727* (2013.01)

(58) Field of Classification Search
CPC ..... H01R 12/737; H01R 12/727
USPC ..... 439/67, 74, 75
See application file for complete search history.

(56) References Cited

U.S. PATENT DOCUMENTS

| | | | |
|---|---|---|---|
| 3,587,029 | A | 6/1971 | Knowles |
| 4,560,221 | A | 12/1985 | Olsson |
| 5,114,353 | A | 5/1992 | Sample |
| 5,676,559 | A | 10/1997 | Laub et al. |
| 6,796,822 | B2 | 9/2004 | Sato et al. |
| 6,918,775 | B2 | 7/2005 | Korsunsky et al. |
| 7,086,866 | B1 | 8/2006 | Folan et al. |
| 7,322,834 | B2 | 1/2008 | Hu et al. |
| 7,326,092 | B2 | 2/2008 | Fedder et al. |

(Continued)

FOREIGN PATENT DOCUMENTS

| | | |
|---|---|---|
| EP | 2346117 A2 | 7/2011 |
| EP | 2451262 A2 | 5/2012 |

(Continued)

OTHER PUBLICATIONS

Kerridge et al., 'Fast Backplane Connectors Disguise Digital Transmission Lines,' (Texas Instrument), Reed Business Information, Highlands Ranch, Co, US, vol. 42, No. Europe, May 8, 1997, XP000724062.

(Continued)

*Primary Examiner* — Khiem M Nguyen

(57) ABSTRACT

A communication system includes a first circuit card assembly having a first PCB including a first slot and a first electrical connector mounted to the first PCB along the first slot and having a first mating end. The communication system includes a second circuit card assembly having a second PCB and a second electrical connector mounted to the second PCB and having a second mating end. The first and second circuit card assemblies are mated along a board mating axis parallel to the first slot with the first PCB oriented perpendicular to the second PCB. The first and second mating ends are oriented parallel to the board mating axis. The second PCB is received in the first slot to align the second mating end with the first mating end.

30 Claims, 7 Drawing Sheets

(56) References Cited

U.S. PATENT DOCUMENTS

| | | | | |
|---|---|---|---|---|
| 7,435,095 | B1 | 10/2008 | Yi | |
| 7,540,744 | B1 | 6/2009 | Minich | |
| 7,708,578 | B1 | 5/2010 | Lenox | |
| 7,771,207 | B2 | 8/2010 | Hamner et al. | |
| 7,789,668 | B1 | 9/2010 | Hamner et al. | |
| 7,824,187 | B1 | 11/2010 | Yi | |
| 7,918,683 | B1 | 4/2011 | Hamner et al. | |
| 7,988,457 | B1 | 8/2011 | Morgan | |
| 8,113,851 | B2 * | 2/2012 | Hamner | H01R 12/714 439/260 |
| 8,199,511 | B2 * | 6/2012 | Kim | H05K 7/1461 312/223.1 |
| 8,376,766 | B1 | 2/2013 | Huettner et al. | |
| 8,512,081 | B2 | 8/2013 | Stokoe | |
| 8,684,610 | B2 * | 4/2014 | Nichols | H01R 13/62911 385/55 |
| 9,551,625 | B2 | 1/2017 | Brugger | |
| 9,608,371 | B2 | 3/2017 | Bonzom et al. | |
| 9,608,382 | B2 | 3/2017 | McClellan et al. | |
| 9,917,406 | B1 | 3/2018 | Iwasaki et al. | |
| 2002/0071259 | A1 | 6/2002 | Roos | |
| 2005/0064733 | A1 | 3/2005 | Korsunsky et al. | |
| 2005/0070136 | A1 | 3/2005 | Korsunsky et al. | |
| 2005/0181637 | A1 | 8/2005 | Williams et al. | |
| 2007/0184676 | A1 | 8/2007 | Minich | |
| 2008/0045087 | A1 | 2/2008 | Yi et al. | |
| 2014/0065849 | A1 | 3/2014 | Kida et al. | |
| 2016/0006150 | A1 | 1/2016 | Bachmutsky et al. | |
| 2018/0040989 | A1 | 2/2018 | Chen | |

FOREIGN PATENT DOCUMENTS

| | | | |
|---|---|---|---|
| JP | 2003044794 | A | 2/2003 |
| TW | M537321 | U | 2/2017 |
| WO | 2007092113 | A2 | 8/2007 |

OTHER PUBLICATIONS

ISR and Written Opinion issued for PCT/IB2018/051321 dated May 31, 2018.

Co-pending application U.S. Appl. No. 15/945,821, filed Apr. 5, 2018.

Co-pending application U.S. Appl. No. 15/945,802, filed Apr. 5, 2018.

Co-pending application U.S. Appl. No. 15/945,787, filed Apr. 5, 2018.

Co-pending application U.S. Appl. No. 15/945,767, filed Apr. 5, 2018.

Co-pending application U.S. Appl. No. 15/945,775, filed Apr. 5, 2018.

Co-pending application U.S. Appl. No. 15/945,812, filed Apr. 5, 2018.

* cited by examiner

CIRCUIT CARD ASSEMBLIES FOR A COMMUNICATION SYSTEM

BACKGROUND OF THE INVENTION

The subject matter herein relates generally to circuit card assemblies for communication systems.

Communication systems are in use in various applications, such as network switches. The communication systems include various circuit cards, such as backplanes and/or daughtercards, which are coupled together to electrically connect various circuits. For example, the circuit cards include electrical connectors that are mated to electrical connectors of one or more other circuit cards. Some communication systems use a backplane or midplane that is perpendicular to the mating direction of the daughtercards. However, such backplanes or midplanes block airflow through the communication system leading to overheating of components or limiting operating speeds to avoid overheating.

Other communication systems arrange both circuit cards parallel to the mating direction to allow airflow through the system. The circuit cards are typically oriented perpendicular to each other (for example, horizontally and vertically). The electrical connectors are provided at edges of both circuit cards and direct mate to each other. Conventional communication systems utilize right angle electrical connectors that direct mate with each other. The mating interfaces of the electrical connectors are parallel to the mating edges of the circuit cards such that the electrical connectors are mated in a direction parallel to the mating direction of the circuit cards. However, such right angle electrical connectors are expensive to manufacture and occupy a large amount of space in the system, thus blocking airflow through the system.

A need remains for a cost effective and reliable communication system allowing airflow through the communication system for cooling the electrical components.

BRIEF DESCRIPTION OF THE INVENTION

In one embodiment, a communication system is provided including a first circuit card assembly having a first PCB and a first electrical connector. The first PCB includes a first slot extending rearward from a first mating edge of the first PCB. The first electrical connector is mounted to the first PCB along the first slot and the first electrical connector having a first mating end. The communication system includes a second circuit card assembly having a second PCB and a second electrical connector. The second PCB has a second mating edge. The second electrical connector is mounted to the second PCB proximate to the mating edge and the second electrical connector having a second mating end. The first and second circuit card assemblies are mated along a board mating axis parallel to the first slot with the first PCB oriented perpendicular to the second PCB. The first and second mating ends of the first and second electrical connectors are oriented parallel to the board mating axis. The second mating edge of the second PCB is received in the first slot to align the second mating end of the second electrical connector with the first mating end of the first electrical connector for mating the second electrical connector with the first electrical connector.

In another embodiment, a circuit card assembly for a communication system is provided including a PCB having a first surface and a second surface extending along a primary axis and a secondary axis. The PCB has a mating edge between the first and second surfaces generally parallel to the secondary axis. The PCB has a slot between the first and second surfaces open at the mating edge and extending a length generally along the primary axis. The PCB has a mounting area on the first surface adjacent the slot and an electrical connector is mounted to the first surface at the mounting area. The electrical connector has a front and a rear opposite the front. The front is provided proximate to the mating edge. The electrical connector has a mounting end extending between the front and the rear being mounted to the mounting area and a mating end extending between the front and the rear generally parallel to the primary axis. The mating end is configured to be mated to a mating electrical connector. The electrical connector has contacts including mating ends at the mating end of the electrical connector and terminating ends at the mounting end terminated to the PCB.

In a further embodiment, a communication system is provided including a first circuit card assembly and a second circuit card assembly. The first circuit card assembly includes a PCB and a first electrical connector mounted to the first PCB. The first PCB has a first surface and a second surface extending along a primary axis and a secondary axis. The first PCB has a first mating edge between the first and second surfaces generally parallel to the secondary axis of the first PCB. The first PCB has a first slot between the first and second surfaces open at the first mating edge and extending a length generally along the primary axis of the first PCB. The first PCB has a first mounting area on the first surface adjacent the first slot with the first electrical connector mounted to the first mounting area. The first electrical connector has a front and a rear opposite the front. A mounting end extends between the front and the rear mounted to the mounting area. A mating end extends between the front and the rear generally parallel to the primary axis of the first PCB. The first electrical connector has first contacts including mating ends at the mating end of the first electrical connector and terminating ends at the mounting end of the first electrical connector terminated to the first PCB. The second circuit card assembly has a second PCB and a second electrical connector mounted to the second PCB. The second PCB has a first surface and a second surface extending along a primary axis and a secondary axis. The second PCB has a second mating edge between the first and second surfaces generally parallel to the secondary axis of the second PCB. The second PCB has a second mounting area on the first surface proximate to the second mating edge with the second electrical connector mounted to the second mounting area. The second electrical connector has a front and a rear opposite the front. A mounting end extends between the front and the rear that is mounted to the mounting area. A mating end extends between the front and the rear generally parallel to the primary axis of the second PCB. The second electrical connector has second contacts including mating ends at the mating end of the second electrical connector and terminating ends at the mounting end of the second electrical connector terminated to the second PCB. The second mating edge of the second PCB is received in the first slot to align the mating end of the second electrical connector with the mating end of the first electrical connector.

DETAILED DESCRIPTION OF THE INVENTION

Figure 1:
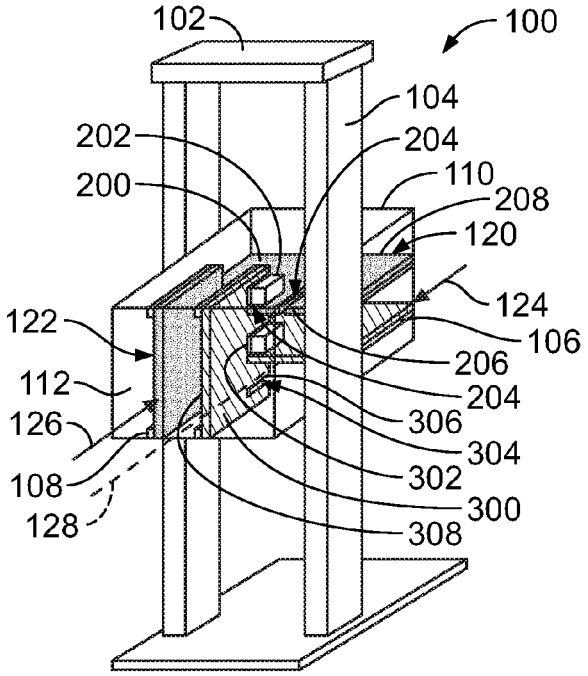
FIG. 1 illustrates a communication system formed in accordance with an exemplary embodiment.

FIG. 1 illustrates a communication system 100 formed in accordance with an exemplary embodiment. The communication system 100 includes a chassis 102 having a frame 104 configured to hold communication components, such as network components, such as circuit card assemblies. Optionally, the chassis 102 may include a cabinet (not shown) surrounding components of the communication system 100. In an exemplary embodiment, the frame 104 includes a plurality of racks 106, 108 for holding circuit card assemblies. For example, the communication system 100 may form part of a data center switch having one or more backplanes and/or daughter cards, such as line cards, switch cards or other types of circuit cards that may be electrically connected together.

In an exemplary embodiment, the communication system 100 includes a front end 110 and a rear end 112. The racks 106 are provided at the front end 110 and the racks 108 are provided at the rear end 112. One or more circuit card assemblies 120 may be received in the racks 106 at the front end 110 and one or more circuit card assemblies 122 may be received in the racks 108 at the rear end 112. The circuit card assemblies 120 may be referred to hereinafter as first circuit card assemblies 120 or front circuit card assemblies to differentiate from the circuit card assemblies 122, which may be referred to hereinafter as second circuit card assemblies 122 and/or rear circuit card assemblies 122. In an exemplary embodiment, the circuit card assemblies 120, 122 are orthogonal to each other. For example, in the illustrated embodiment, the front circuit card assemblies 120 are oriented vertically while the rear circuit card assemblies 122 are oriented horizontally; however, other orientations are possible in alternative embodiments.

The front circuit card assemblies 120 are electrically connected to one or more of the rear circuit card assemblies 122. Optionally, the front circuit card assemblies 120 and/or the rear circuit card assemblies 122 may be removable from the corresponding racks 106, 108. The racks 106, 108 guide and position the circuit card assemblies 120, 122, respectively. For example, the racks 106 position the front circuit card assemblies 120 for mating with multiple rear circuit card assemblies 122 and the racks 108 position the rear circuit card assemblies 122 for mating with multiple front circuit card assemblies 120. The front circuit card assemblies 120 may be loaded into the frame 104 through the front end 110 while the rear circuit card assemblies 122 may be loaded into the frame 104 through the rear end 112. For example, the front circuit card assemblies 120 are configured to be loaded into corresponding racks 106 in a loading direction 124 and the rear circuit card assemblies 122 are configured to be loaded into corresponding racks 108 in a loading direction 126. The loading directions 124, 126 may be parallel to a loading axis 128.

The first circuit card assembly 120 includes a first printed circuit board (PCB) 200 and a first electrical connector 202 mounted to the first PCB 200. The first PCB 200 may include any number of the electrical connectors 202, such as one electrical connector 202 for electrically connecting to each corresponding second circuit card assembly 122. Optionally, the first PCB 200 may include one or more first slots 204 for receiving PCBs of corresponding second circuit card assemblies 122 when mated thereto.

The first PCB 200 extends between a first mating edge 206 at a front of the PCB 200 and a rear edge 208 opposite the mating edge 206. Optionally, the rear edge 208 may include a handle or other feature for insertion and removal of the first circuit card assembly 120. The first PCB 200 may include one or more electrical components 210 thereon. For example, the electrical components 210 may be processors, memory modules, batteries, fans, signal processing devices, and the like.

The second circuit card assembly 122 includes a second PCB 300 and a second electrical connector 302 mounted to the second PCB 300. The second PCB 300 may include any number of the electrical connectors 302, such as one electrical connector 302 for electrically connecting to each corresponding first circuit card assembly 120. The second PCB 300 extends between a second mating edge 306 at a front of the PCB 300 and a rear edge 308 opposite the mating edge 306. The first and second mating edges 206, 306 of the first and second PCBs 200, 300 interface with each other when the first and second circuit card assemblies 120, 122 are mated. For example, the fronts of the PCBs 200, 300 face each other and the rear edges 208, 308 face away from each other. Optionally, the rear edge 308 may include a handle or other feature for insertion and removal of the second circuit card assembly 122. The second PCB 300 may include one or more electrical components 310 thereon. For example, the electrical components 310 may be processors, memory modules, batteries, fans, signal processing devices, and the like.

Optionally, the second PCB 300 may include one or more second slots 304 for receiving first PCBs 200 of corresponding first circuit card assemblies 120 when mated thereto. In various embodiments, both PCBs 200, 300 include the first and second slots 204, 304. In other various embodiments, only the first PCB 200 includes the first slots 204, whereas in other various embodiments, only the second PCB 300 includes the second slots 304.

The first slots 204 and/or the second slots 304 allow the first and second PCBs 200, 300 to be internested such that the first and second electrical connectors 202, 302 are aligned for mating. For example, the first slots 204 and/or the second slots 304 allow the first and second PCBs 200, 300 to overlap to align mating ends of the first and second electrical connectors 202, 302 for mating. The arrangement allows the first and second electrical connectors 202, 302 to be mated in a mating direction perpendicular to the loading directions 124, 126. The arrangement allows the first and second electrical connectors 202, 302 to be elongated along the PCBs 200, 300 reducing one or more other dimensions of the electrical connectors 202, 302 (for example, a height and/or a width) allowing a greater amount of airflow through the communication system 100 (for example, from the front end 110 to the rear end 112 and/or from the rear end 112 to the front end 110. The arrangement may allow the PCBs 200, 300 to overlap to reduce one or more dimensions of the communication system 100, such as a front to rear length of the communication system 100.

Figure 2:
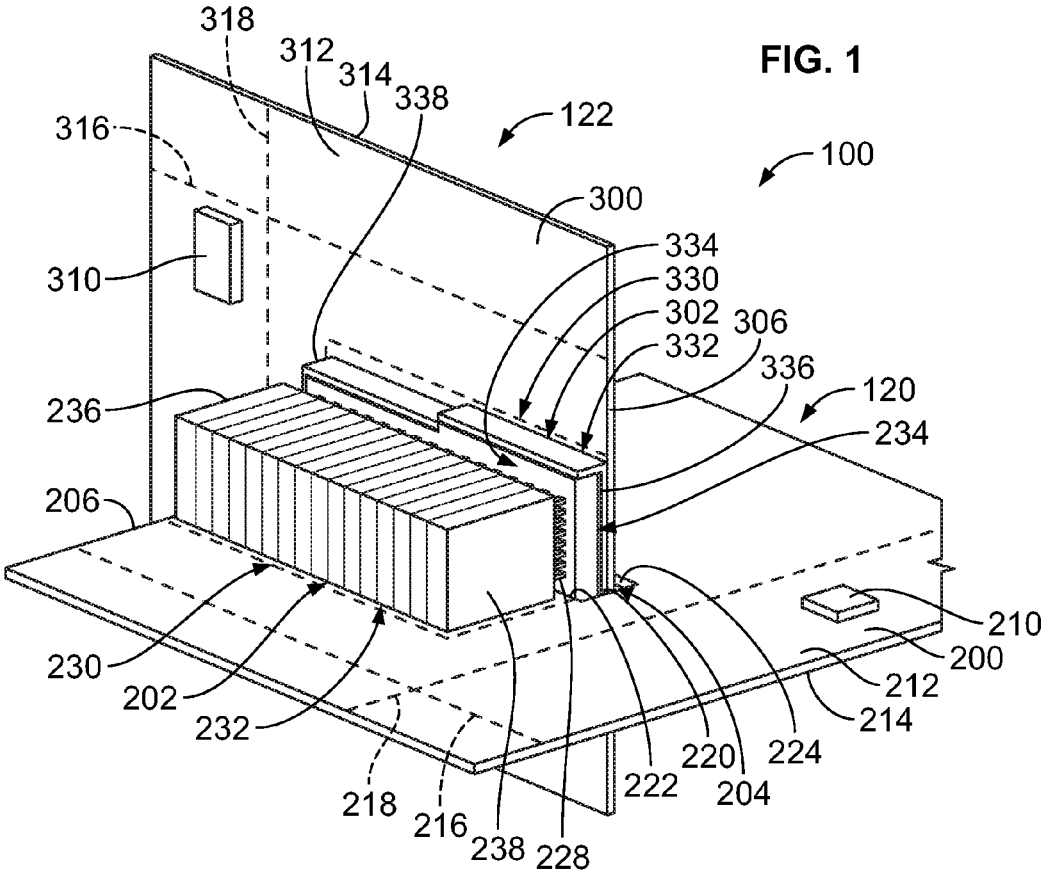
FIG. 2 is a perspective view of a portion of the communication system showing a first circuit card assembly coupled to a second circuit card assembly.
Figure 3:
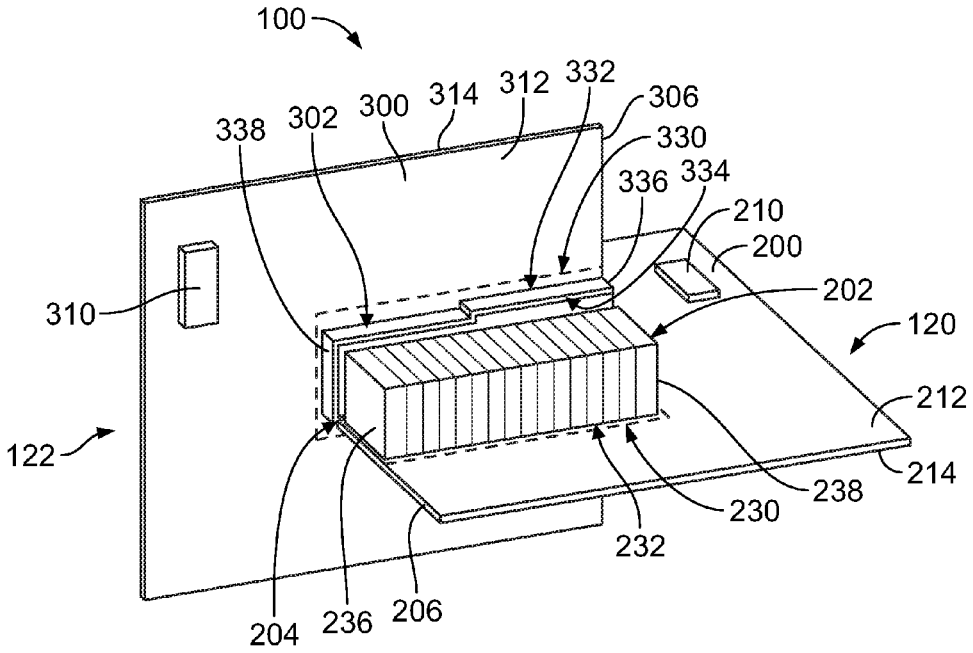
FIG. 3 is a perspective view of a portion of the communication system showing the first circuit card assembly coupled to the second circuit card assembly.
Figure 4:
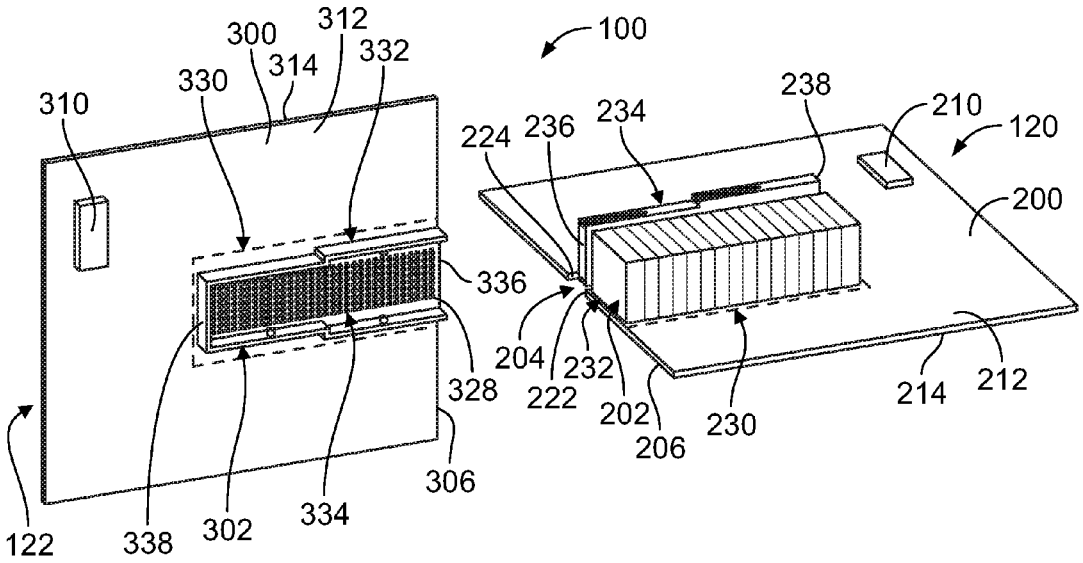
FIG. 4 is a perspective view of a portion of the communication system showing the first circuit card assembly and the second circuit card assembly poised for mating.
Figure 5:
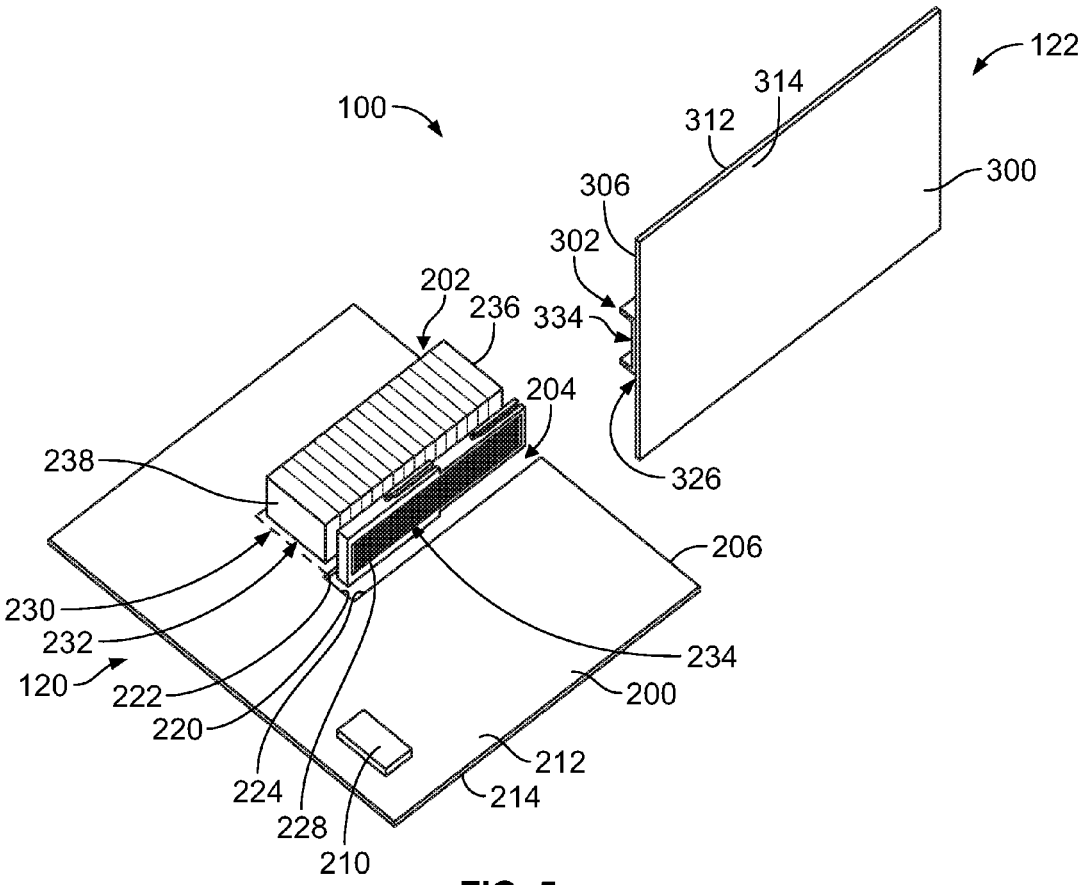
FIG. 5 is a perspective view of a portion of the communication system showing the first circuit card assembly and the second circuit card assembly poised for mating.

FIG. 2 is a perspective view of a portion of the communication system 100 showing the first circuit card assembly 120 coupled to the second circuit card assembly 122; however, it is noted that the first circuit card assembly 120 may be designed to be coupled to multiple circuit card assemblies 122 and/or the circuit card assembly 122 may be designed to be coupled to multiple circuit card assemblies 120, such as in the arrangement illustrated in FIG. 1. FIG. 3 is a perspective view of a portion of the communication system 100 showing the first circuit card assembly 120 coupled to the second circuit card assembly 122. FIG. 4 is a perspective view of a portion of the communication system 100 showing the first circuit card assembly 120 and the second circuit card assembly 122 poised for mating. FIG. 5 is a perspective view of a portion of the communication system 100 showing the first circuit card assembly 120 and the second circuit card assembly 122 poised for mating.

The terms "first", "second", etc. are used merely as labels to generally identify components of the first circuit card assembly 120 or the second circuit card assembly 122, respectively; however, such labels are not used exclusively with the circuit card assemblies 120, 122. Either or both of the circuit card assemblies 120, 122 may include any of the various components or elements described herein and some components may only be described with respect to either the circuit card assembly 120 or the circuit card assembly 122; however, the other of the circuit card assembly 120 or the circuit card assembly 122 may additionally include such components. Furthermore, the components may be described herein with or without the "first" label or the "second" label.

The circuit card assembly 120 includes the PCB 200 having the first slot 204 and the electrical connector 202 mounted to the PCB 200 proximate to the first slot 204. The PCB 200 includes a first surface 212 and a second surface 214 being the main surfaces of the PCB 200. In the illustrated embodiment, the first surface 212 is an upper surface and the second surface 214 is a lower surface; however, the PCB 200 may have other orientations in alternative embodiments. The first and second surfaces 212, 214 extend along a primary axis 216 and a secondary axis 218 perpendicular to the primary axis 216. In an exemplary embodiment, the primary and secondary axes 216, 218 are in a horizontal plane; however, the PCB 200 may have other orientations in alternative embodiments. In an exemplary embodiment, the primary axis 216 extends between the mating edge 206 and the rear edge 208 (shown in FIG. 1). In an exemplary embodiment, the secondary axis 218 is parallel to the mating edge 206.

The first slot 204 extends entirely through the PCB 200 between the first and second surfaces 212, 214. The first slot 204 is open at the mating edge 206 to receive the second circuit card assembly 122. The first slot 204 extends a length along the primary axis 216 to an end edge 220 remote from the mating edge 206. The first slot 204 has first and second side edges 222, 224 extending between the mating edge 206 and the end edge 220. Optionally, the side edges 222, 224 may be generally parallel to each other. Alternatively, the side edges 222, 224 may be nonparallel, such as to taper the first slot 204. For example, the first slot 204 may be wider near the mating edge 206 and narrower near the end edge 220. Optionally, the side edges 222, 224 may have chamfered lead-ins at the mating edge 206 to guide the second circuit card assembly 122 into the first slot 204.

The PCB 200 includes a mounting area 230 for the electrical connector 202 on the first surface 212. The mounting area 230 is adjacent the first slot 204. For example, the mounting area 230 extends along the mating edge 206 a distance from the first slot 204 and extends along the first side edge 222 of the first slot 204 a distance from the mating edge 206. Optionally, the mounting area 230 may extend beyond the end edge 220 of the first slot 204. The electrical connector 202 is terminated to the PCB 200 at the mounting area 230. For example, contacts 228 that extend through the electrical connector 202 may be soldered to the PCB 200 at the mounting area 230. The mounting area 230 may include plated vias that receive compliant pins or solder tails of the contacts 228 of the electrical connector 202 for termination of the contacts 228 to the PCB 200. Optionally, at least a portion of the electrical connector 202 may extend beyond the first side edge 222 over the first slot 204 and/or at least a portion of the electrical connector 202 may extend forward of the mating edge 206 and/or at least a portion of the electrical connector 202 may extend rearward of the end edge 220. In other various embodiments, the PCB 200 may include more than one mounting area 230 adjacent the first slot 204 for receiving additional electrical connectors 202. For example, multiple electrical connectors 202 may be electrically connected to the same circuit card assembly 122. For example, additional electrical connectors 202 may be provided on both sides of the first slot 204 and/or both sides of the PCB 200.

The electrical connector 202 is mounted to the PCB 200 at the mounting area 230. In the illustrated embodiment, the electrical connector 202 is a right angle connector having a mounting end 232 perpendicular to a mating end 234. For example, the mounting end 232 may be provided at a bottom of the electrical connector 202 and the mating end 234 may be provided at a side of the electrical connector 202. The electrical connector 202 extends between a front 236 and a rear 238 opposite the front 236. The mounting end 232 extends between the front 236 and the rear 238 at the bottom of the electrical connector 202. The mounting end 232 is mounted to the PCB 200. For example, the electrical connector 202 is mechanically and electrically terminated to the PCB 200 at the mounting end 232. The mating end 234 extends between the front 236 and the rear 238. In the illustrated embodiment, the mating end 234 generally faces the first slot 204 for interfacing with the second electrical connector 302 when the second circuit card assembly 122 is received in the first slot 204. The mating end 234 is configured to be mated to the mating electrical connector defined by the second electrical connector 302 when the second circuit card assembly 122 is received in the first slot 204.

In an exemplary embodiment, the mating end 234 is oriented generally vertically and extends parallel to the primary axis 216. The mating end 234 faces sideways rather than forward. For example, the mating end 234 is perpendicular to the mating edge 206 of the PCB 200. The front 236 is oriented generally vertically and extends parallel to the secondary axis 218. The front 236 may be positioned a first distance from the mating edge 206 (either forward of, rearward of or flush with the mating edge 206) and the rear 238 is positioned a second distance from the mating edge 206 greater than the first distance. The mating end 234 spans a majority of the distance between the front 236 and the rear 238. The front 236 is forward facing and, in the illustrated embodiment, is provided near the mating edge 206, such as generally flush with the mating edge 206.

The circuit card assembly 122 includes the PCB 300, which may or may not include a slot. In the illustrated embodiment, the PCB 300 does not include a slot. The PCB 300 includes a first surface 312 and a second surface 314 being the main surfaces of the PCB 300. In the illustrated embodiment, the first surface 312 defines a first side and the second surface 314 defines a second side of the PCB 300; however, the PCB 300 may have other orientations in alternative embodiments. The first and second surfaces 312, 314 extend along a primary axis 316 and a secondary axis 318 perpendicular to the primary axis 316. In an exemplary embodiment, the primary and secondary axes 316, 318 are in a vertical plane; however, the PCB 300 may have other orientations in alternative embodiments. In an exemplary embodiment, the primary axis 316 extends between the mating edge 306 and the rear edge 308 (shown in FIG. 1). In an exemplary embodiment, the secondary axis 318 is parallel to the mating edge 306.

In an exemplary embodiment, the PCB 300 includes a filler strip 326 (FIG. 5), which is a portion of the PCB 300 configured to be received in the first slot 204 that may at least partially fill the first slot 204. The filler strip 326 has a width approximately equal to a thickness of the first PCB 200. The filler strip 326 may engage the end edge 220, the first side edge 222 and/or the second side edge 224 of the first slot 204 when received therein.

The PCB 300 includes a mounting area 330 for the electrical connector 302 on the first surface 312. The mounting area 330 is adjacent the filler strip 326. For example, the mounting area 330 extends along the mating edge 306 a distance from the filler strip 326 and extends along the filler strip 326 a distance from the mating edge 306. Optionally, the mounting area 330 may extend beyond the filler strip 326 (for example, rearward of the filler strip 326). The electrical connector 302 is terminated to the PCB 300 at the mounting area 330. For example, contacts 328 of the electrical connector 302 may be soldered to the PCB 300 at the mounting area 330. The mounting area 330 may include plated vias that receive compliant pins or solder tails of the contacts 328 of the electrical connector 302 for termination of the contacts 328 to the PCB 300. Optionally, at least a portion of the electrical connector 302 may extend forward of the mating edge 306 and/or at least a portion of the electrical connector 302 may extend rearward of the filler strip 326. In other various embodiments, the PCB 300 may include more than one mounting area 330 for receiving additional electrical connectors 302. For example, multiple electrical connectors 302 may be electrically connected to the same circuit card assembly 122. For example, additional electrical connectors 302 may be provided on both sides of the filler strip 326 and/or both sides of the PCB 300.

The electrical connector 302 is mounted to the PCB 300 at the mounting area 330. In the illustrated embodiment, the electrical connector 302 is a header connector having a mounting end 332 parallel to a mating end 334. For example, the mounting end 332 may be provided along one side of the electrical connector 302 and the mating end 334 may be provided at the opposite side of the electrical connector 302. Optionally, the mounting end 332 and the mating end 334 may be parallel to each other and non-coplanar. The electrical connector 302 extends between a front 336 and a rear 338 opposite the front 336. The mounting end 332 and the mating end 334 both extend between the front 336 and the rear 338. The mounting end 332 is mounted to the PCB 300. For example, the electrical connector 302 is mechanically and electrically terminated to the PCB 300 at the mounting end 332. In the illustrated embodiment, the mating end 334 is oriented for interfacing with the first electrical connector 202 when the second circuit card assembly 122 is received in the first slot 204.

In an exemplary embodiment, the mating end 334 is oriented generally vertically and extends parallel to the primary axis 316. The mating end 334 faces sideways rather than forward. For example, the mating end 334 is perpendicular to the mating edge 306 of the PCB 300. The front 336 is oriented generally vertically and extends parallel to the secondary axis 318. The front 336 may be positioned a first distance from the mating edge 306 (either forward of, rearward of or flush with the mating edge 306) and the rear 338 is positioned a second distance from the mating edge 306 greater than the first distance. The mating end 334 spans a majority of the distance between the front 336 and the rear 338. The front 336 is forward facing and, in the illustrated embodiment, is provided near the mating edge 306, such as generally flush with the mating edge 306.

When the first and second circuit card assemblies 120, 122 are mated, the first and second PCBs 200, 300 are internested and the second PCB 300 is received in the first slot 204. When mated, the first PCB 200 at least partially overlaps with the second PCB 300 to align the mating ends 234, 334 of the electrical connectors 202, 302. For example, the mating edges 206, 306 bypass each other as the second PCB 300 is received in the first slot 204.

Figure 6:
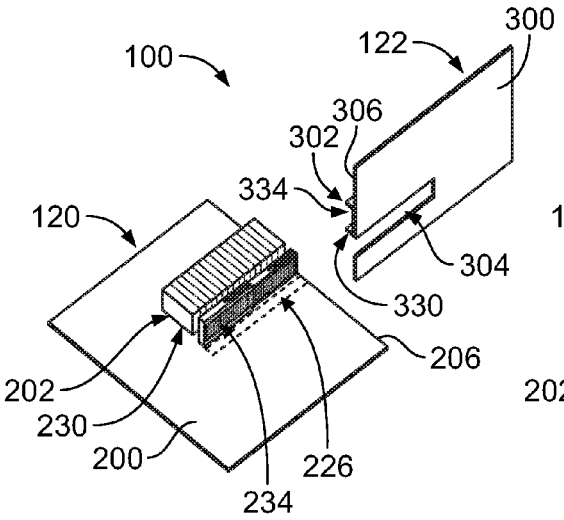
FIG. 6 is a perspective view of a portion of the communication system in accordance with an exemplary embodiment.

FIG. 6 is a perspective view of a portion of the communication system 100 in accordance with an exemplary embodiment. FIG. 6 shows the second circuit card assembly 122 with the second slot 304 and the first circuit card assembly 120 without the first slot 204 (shown in FIG. 5). The first PCB 200 includes a filler strip 226 adjacent the mounting area 230 configured to at least partially fill the second slot 304. The second electrical connector 302 is mounted to the mounting area 330 adjacent the second slot 304. When the first and second circuit card assemblies 120, 122 are mated, the first and second PCBs 200, 300 are internested with the first PCB 200 being received in the second slot 304. When mated, the first PCB 200 at least partially overlaps with the second PCB 300 to align the mating ends 234, 334 of the electrical connectors 202, 302. For example, the mating edges 206, 306 bypass each other as the first PCB 200 is received in the second slot 304.

Figure 7:
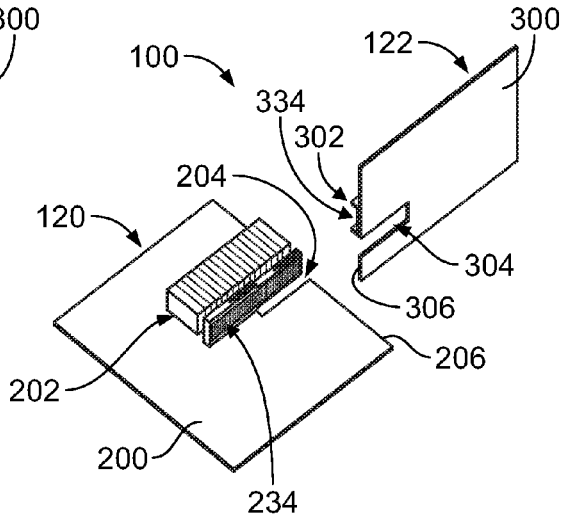
FIG. 7 is a perspective view of a portion of the communication system in accordance with an exemplary embodiment.

FIG. 7 is a perspective view of a portion of the communication system 100 in accordance with an exemplary embodiment. FIG. 7 shows the first circuit card assembly 120 with the first slot 204 and the second circuit card assembly 122 with the second slot 304. When the first and second circuit card assemblies 120, 122 are mated, the first and second PCBs 200, 300 are internested with the first PCB 200 being received in the second slot 304 and with the second PCB 300 being received in the first slot 204. When mated, the first PCB 200 at least partially overlaps with the second PCB 300 to align the mating ends 234, 334 of the electrical connectors 202, 302. For example, the mating edges 206, 306 bypass each other as the PCBs 200, 300 are received in the second and first slots 304, 204, respectively.

Figure 8:
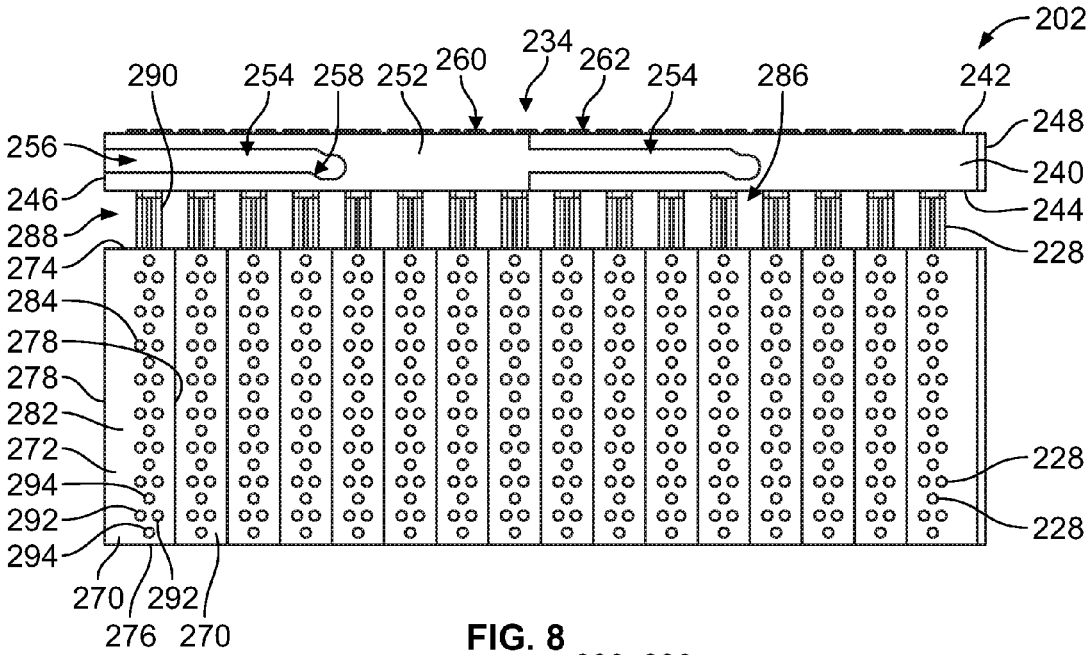
FIG. 8 is a bottom view of a first electrical connector of the first circuit card assembly in accordance with an exemplary embodiment.
Figure 9:
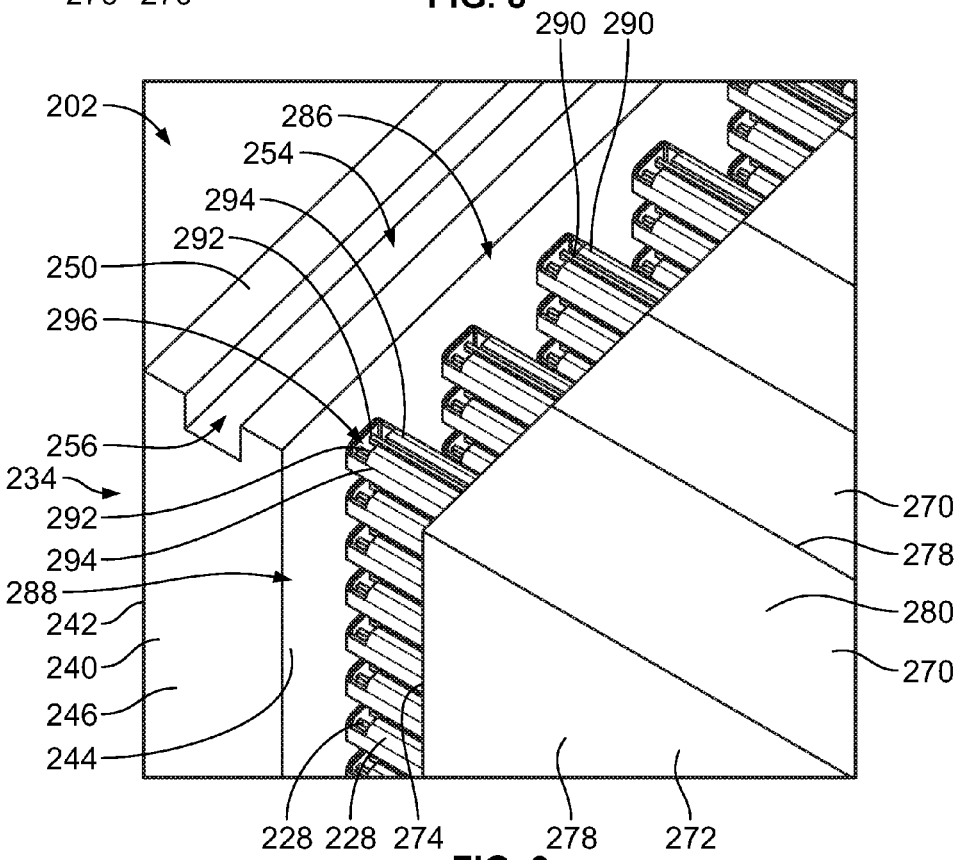
FIG. 9 is a perspective view of a portion of the first electrical connector in accordance with an exemplary embodiment.
Figure 10:
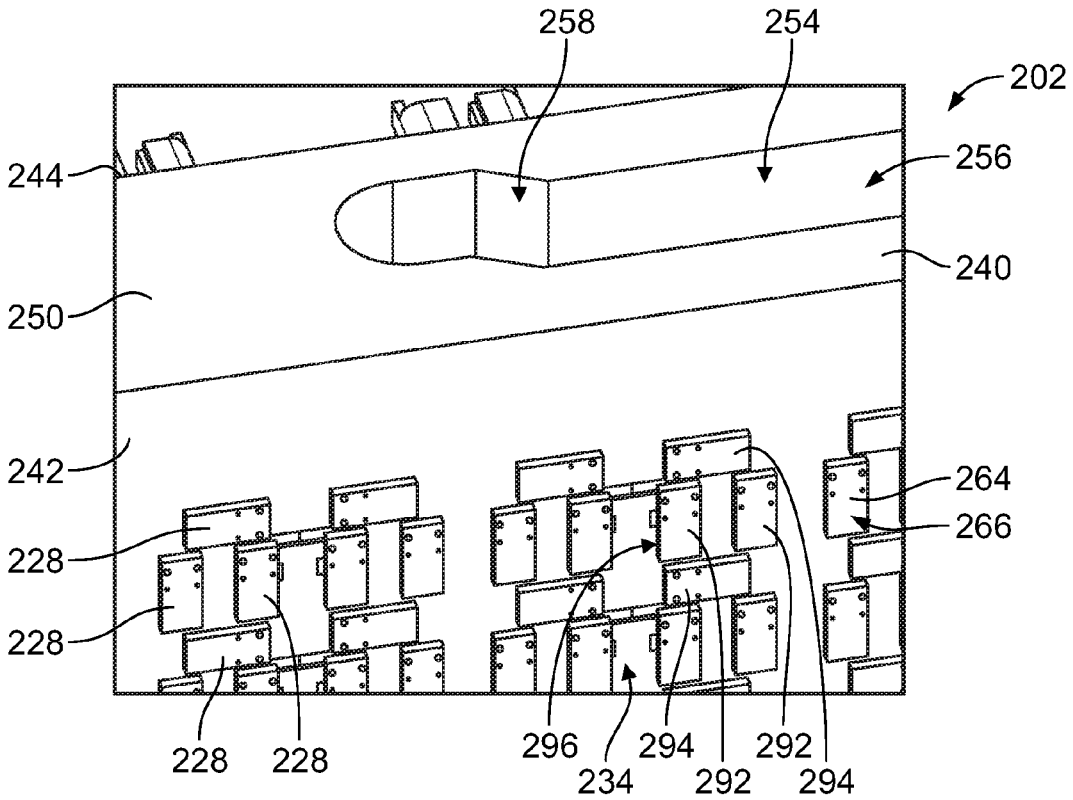
FIG. 10 is an end view of a portion of the first electrical connector in accordance with an exemplary embodiment.

FIG. 8 is a bottom view of the first electrical connector 202 in accordance with an exemplary embodiment. FIG. 9 is a perspective view of a portion of the first electrical connector 202 in accordance with an exemplary embodiment. FIG. 10 is an end view of a portion of the first electrical connector 202 in accordance with an exemplary embodiment.

In an exemplary embodiment, the electrical connector 202 includes a mating housing 240 at the mating end 234. The mating housing 240 includes a first side 242, a second side 244, a front 246 and a rear 248. The first side 242 defines the mating end 234 of the electrical connector 202. The mating end 234 is oriented perpendicular to the first PCB 200. In an exemplary embodiment, the mating housing 240 holds the contacts 228 for mating with the second electrical connector 302 (shown in FIG. 2). For example, each of the contacts 228 includes a mating end 264 (FIG. 10) exposed at or beyond the first side 242 for mating with the second electrical connector 302. The mating ends 264 are provided at the first side 242 in a predetermined layout for mating with the second electrical connector 302. In the illustrated embodiment, the mating ends 264 are pads (FIG. 10) at the first side 242. For example, the ends of the contacts 228 may be folded or bent over along the first side 242 to define mating interfaces 266 (FIG. 10) provided along the plane defined by the first side 242 of the mating housing 240. Other types of mating ends may be provided in alternative embodiments, such as spring beams, pins, sockets, and the like.

The mating housing 240 includes a top 250 and a bottom 252. In an exemplary embodiment, the top 250 and the bottom 252 include connecting elements 254 for connecting the first electrical connector 202 to the second electrical connector 302. In the illustrated embodiment, the connecting elements 254 are defined by grooves 256 in the top 250 and the bottom 252. In an exemplary embodiment, at ends of the grooves 256, the connecting elements 254 include cam surfaces 258 to facilitate mating of the second electrical connector 302 with the first electrical connector 202, such as described in further detail below. Other types of connecting elements 254 may be provided in alternative embodiments, such as pins, clips, fasteners, and the like.

Optionally, the top 250 and the bottom 252 may be stepped having a front section 260 and a rear section 262. The front section 260 includes one or more of the connecting elements 254 and the rear section 262 includes one or more of the connecting elements 254. Optionally, the mating housing 240 may be taller at the rear sections 262 and shorter at the front sections 260 to allow mating with the second electrical connector 302.

In an exemplary embodiment, the electrical connector 202 includes contact modules 270 each holding a plurality of the contacts 228. The contact modules 270 may be coupled to the mating housing 240, such as at the second side 244. In an exemplary embodiment, each contact module 270 includes a dielectric body 272 holding corresponding contacts 228. For example, the dielectric body 272 may be overmolded around portions of the contacts 228. Optionally, the contact modules 270 may include ground shields (not shown) to provide electrical shielding for the contacts 228.

The contact modules 270 each have a first side 274 facing the mating housing 240 and a second side 276 opposite the first side 274. The contact module 270 includes sides 278 facing each other when the contact modules 270 are stacked front to rear within the electrical connector 202. Any number of the contact modules 270 may be stacked together depending on the particular application. The number of contacts 228 within the electrical connector 202 may be increased or decreased by changing the number of contact modules 270 rather than retooling to increase the number of contacts per contact module, as is common in conventional systems, such retooling being expensive. The contact module 270 includes a top 280 and a bottom 282. The bottom 282 is configured to be mounted to the first PCB 200 (shown in FIG. 2). Optionally, portions of the contacts 228 may extend below the bottom 282 for termination to the first PCB 200. For example, each of the contacts 228 may include a terminating end 284 (FIG. 8) configured to be terminated to the first PCB 200. For example, the terminating end 284 may be a compliant pin, such as an eye of the needle pin, configured to be press-fit into plated vias in the first PCB 200. In other various embodiments, the terminating end 284 may be a solder tail or another type of terminating end.

In an exemplary embodiment, the electrical connector 202 includes a compliant section 286 that allows the mating end 234 to shift rearward relative to the contact modules 270, such as during mating with the second electrical connector 302. The compliant section 286 may be provided between the second side 244 of the mating housing 240 and the first sides 274 of the contact modules 270. For example, the contact modules 270 may not engage the mating housing 240 in various embodiments. Rather, a gap 288 may be provided between the first sides 274 of the contact modules 270 and the second side 244 of the mating housing 240. The contacts 228 may span the gap 288 between the contact modules 270 and the mating housing 240. The contacts 228 include flexible sections 290 between the mating ends 264 and the terminating ends 284 to allow relative movement of the contacts 228 and the mating housing 240. The flexible sections 290 may be defined by sections of the contacts 228 that are not encased or enclosed by the dielectric body 272 and/or do not extend through the mating housing 240. For example, the flexible sections 290 may be located in the gap 288. Optionally, the flexible sections 290 may be enclosed or shrouded by a portion of the electrical connector 202, such as a shroud extending from the second side 244 of the mating housing 240 or a separate housing component.

In an exemplary embodiment, the contacts 228 include signal contacts 292 and ground contacts 294. Optionally, the signal contacts 292 may be arranged in pairs 296 configured to convey differential signals. The ground contacts 294 are interspersed with the signal contacts 292 to provide electrical shielding for the signal contacts 292. For example, the ground contacts 294 may be provided between the pairs 296 of signal contacts 292. Optionally, the ground contacts 294 may be provided above, below, and/or between the various pairs 296 of signal contacts 292. The signal contacts 292 and/or the ground contacts 294 may be stamped and formed contacts.

Figure 11:
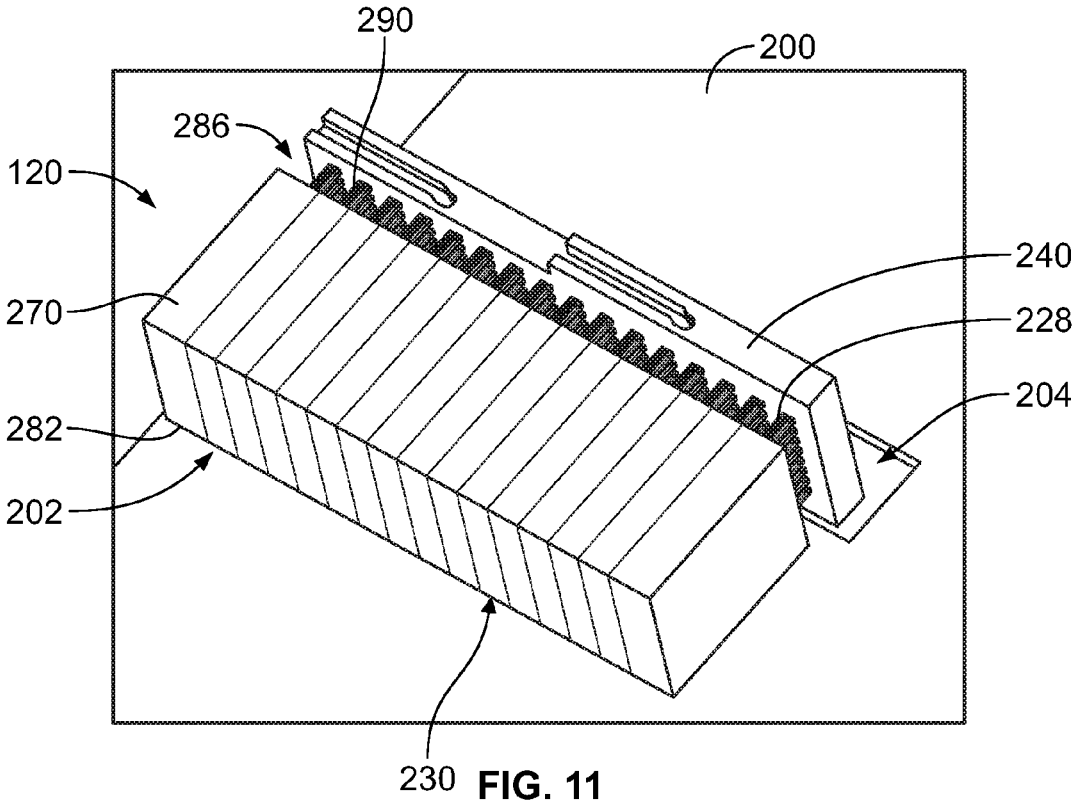
FIG. 11 is a top perspective view of a portion of the first circuit card assembly showing the first electrical connector mounted to a first PCB.

FIG. 11 is a top perspective view of a portion of the first circuit card assembly 120 showing the first electrical connector 202 mounted to the first PCB 200 at the mounting area 230 adjacent the first slot 204. The bottoms 282 of the contact modules 270 are mounted to the PCB 200. In an exemplary embodiment, the mating housing 240 is positioned above the first slot 204 for mating with the second electrical connector 302 (shown in FIG. 2). In an exemplary embodiment, the mating housing 240 is movable relative to the PCB 200 and the contact modules 270, which are fixed to the PCB 200. For example, the flexible sections 290 of the contacts 228 defining the compliant section 286 of the electrical connector 202 allow the mating housing 240 to move relative to the PCB 200 during mating with the second electrical connector 302.

Figure 12:
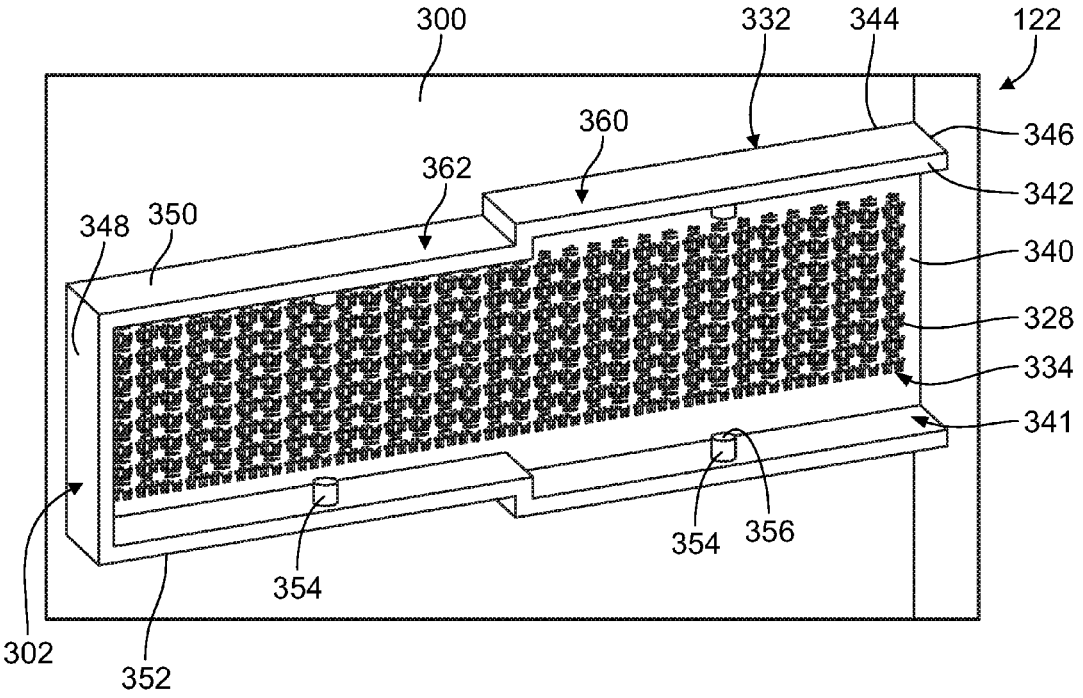
FIG. 12 is a perspective view of a portion of the second circuit card assembly in accordance with an exemplary embodiment.
Figure 13:
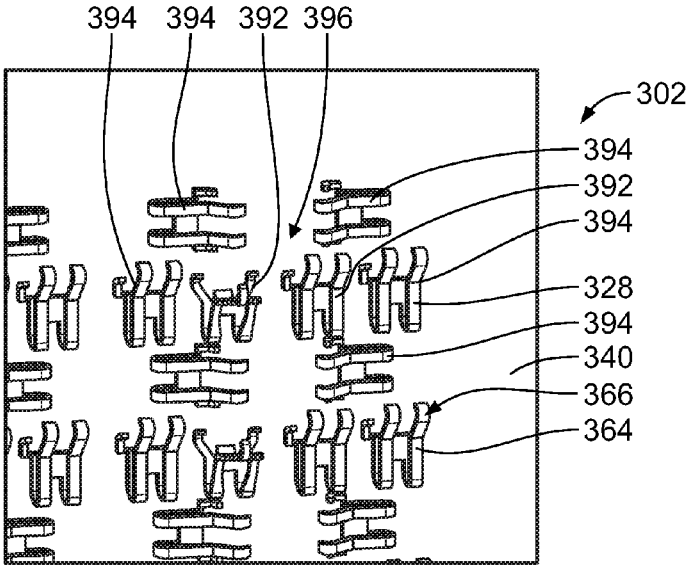
FIG. 13 is a perspective view of a portion of the second electrical connector in accordance with an exemplary embodiment.

FIG. 12 is a perspective view of a portion of the second circuit card assembly 122 in accordance with an exemplary embodiment. FIG. 13 is a perspective view of a portion of the second electrical connector 302 in accordance with an exemplary embodiment. In an exemplary embodiment, the electrical connector 302 includes a housing 340 holding the contacts 328. The housing 340 includes walls defining a cavity 341 configured to receive the mating housing 240 of the first electrical connector 202 (both shown in FIG. 11).

The housing 340 includes a first side 342, a second side 344, a front 346 and a rear 348. The first side 342 defines the mating end 334 of the electrical connector 302. The mating end 334 is oriented parallel to the second PCB 300. In an exemplary embodiment, the housing 340 holds the contacts 328 for mating with the first electrical connector 202. For example, each of the contacts 328 includes a mating end 364 (FIG. 13) exposed at or beyond the first side 342 for mating with the first electrical connector 202. The mating ends 364 are provided at the first side 342 in a predetermined layout for mating with the first electrical connector 202. In the illustrated embodiment, the mating ends 364 are spring beams folded or bent over to allow an amount of deflection, such as for mating with the contacts 228 of the first electrical connector 202. The mating ends 364 define mating interfaces 366 (FIG. 13). Other types of mating ends may be provided in alternative embodiments, such as pads, pins, sockets, and the like.

The housing 340 includes a top 350 and a bottom 352. In an exemplary embodiment, the top 350 and the bottom 352 include connecting elements 354 for connecting the second electrical connector 302 to the first electrical connector 202. In the illustrated embodiment, the connecting elements 354 are defined by pins 356 extending into the cavity 341 generally at the top 350 and the bottom 352. The pins 356 are configured to be received in the corresponding grooves 256 (shown in FIG. 9) of the mating housing 240. The pins 356 may ride along the cam surfaces 258 (shown in FIGS. 8 and 10) as the second electrical connector 302 is mated with the first electrical connector 202 to drive the mating ends 364 of the contacts 328 into mating engagement with the contacts 228. Other types of connecting elements 354 may be provided in alternative embodiments, such as grooves, clips, fasteners, and the like.

Optionally, the top 350 and the bottom 352 may be stepped having a front section 360 and a rear section 362. The front section 360 includes one or more of the connecting elements 354 and the rear section 362 includes one or more of the connecting elements 354. Optionally, the cavity 341 may be taller at the front section 360 and shorter at the rear section 362 to allow mating with the first electrical connector 202.

The housing 340 defines the mounting end 332 of the electrical connector 302 configured to be mounted to the PCB 300. Optionally, portions of the contacts 328 may extend beyond the mounting end 332 for termination to the PCB 300. For example, the contacts 328 may include terminating ends (not shown), such as compliant pins, solder tails, and the like, configured to be terminated to the PCB 300.

In an exemplary embodiment, the contacts 328 include signal contacts 392 and ground contacts 394. Optionally, the signal contacts 392 may be arranged in pairs 396 configured to convey differential signals (differential pairs of signal contacts); however, the signal contacts 392 may convey single-ended signals rather than differential signals. The ground contacts 394 are interspersed with the signal contacts 392 to provide electrical shielding for the signal contacts 392. For example, the ground contacts 394 may be provided between the pairs 396 of signal contacts 392.

Figure 14:
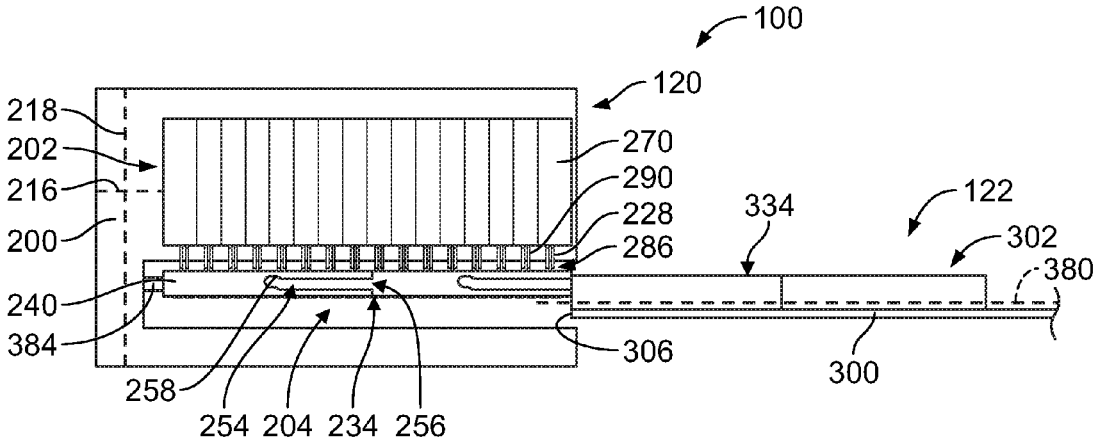
FIG. 14 shows the second circuit card assembly poised for mating with the first circuit card assembly.
Figure 15:
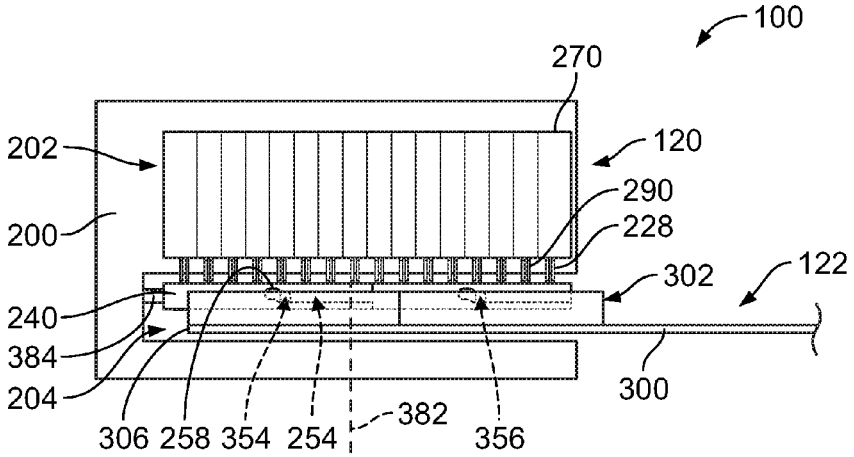
FIG. 15 shows the second circuit card assembly partially mated with the first circuit card assembly.
Figure 16:
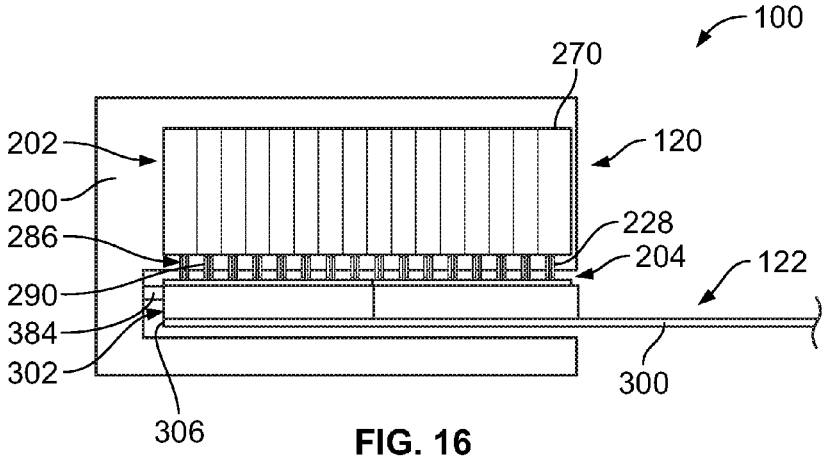
FIG. 16 shows the second circuit card assembly fully mated with the first circuit card assembly.

FIGS. 14-16 illustrate a mating sequence of the first circuit card assembly 120 with the second circuit card assembly 122. FIG. 14 shows the second circuit card assembly 122 poised for mating with the first circuit card assembly 120. FIG. 15 shows the second circuit card assembly 122 partially mated with the first circuit card assembly 120. FIG. 16 shows the second circuit card assembly 122 fully mated with the first circuit card assembly 120. While the mating sequence is described as the first circuit card assembly 120 being fixed and the second circuit card assembly 122 being moved into position relative to the first circuit card assembly 120, it should be realized that in alternative embodiments, the second circuit card assembly 122 may be fixed and the first circuit card assembly 120 may be moved into position relative to the second circuit card assembly 122.

During mating, the second circuit card assembly 122 is aligned with the first slot 204 (for embodiments having the second slot 304, the first circuit card assembly 120 is aligned with the second slot 304). The circuit card assemblies 120, 122 are mated along a board mating axis 380 parallel to the first slot 204. When mated, the first PCB 200 is oriented perpendicular to the second PCB 300. For example, in various embodiments, the first PCB 200 is oriented horizontally while the second PCB 300 is oriented vertically. However, both PCBs 200, 300 are aligned with the board mating axis 380, which may be parallel to the primary axis 216. As such, air is able to flow past the circuit card assemblies 120, 122 along the board mating axis 380 with minimal interference from either PCB 200, 300. The electrical connectors 202, 302 are elongated along the board mating axis 380 to reduce the cross-sectional area of the electrical connectors 202, 302 to reduce blocking of the airflow. The first and second mating ends 234, 334 of the first and second electrical connectors 202, 302 are oriented parallel to the board mating axis 380.

The first PCB 200 is mated with the second PCB 300 in a board mating direction along the board mating axis 380. As the second circuit card assembly 122 is moved along the board mating axis 380, the second mating edge 306 of the second PCB 300 is received in the first slot 204. The second circuit card assembly 122 is moved into the first slot 204 to generally align the second mating end 334 of the second electrical connector 302 with the first mating end 234 of the first electrical connector 202 along the board mating axis 380 (see, for example, FIG. 14).

As the circuit card assembly 122 is moved, the second electrical connector 302 is mated with the first electrical connector 202 in a connector mating direction along a connector mating axis 382 (see, for example, FIG. 15). The connector mating direction may be generally parallel to the secondary axis 218. In various embodiments, the connector mating axis 382 may be generally perpendicular to the board mating axis 380.

During mating, the connecting elements 254 interact with the connecting elements 354 to mate the first and second electrical connectors 202, 302 along the connector mating axis 382. For example, the grooves 256 receive the pins 356 as the second card circuit assembly 122 is moved into the first slot 204. The grooves 256 guide the pins 356 into the cam surface 258 to cam the second electrical connector 302 in the mating direction relative to the first electrical connector 202 along the connector mating axis 382. The cam surfaces 258 transfer movement of the second circuit card assembly 122 in the board mating direction to movement of the second electrical connector 302 in the connector mating direction, generally perpendicular to the board mating direction.

During insertion of the second circuit card assembly 122 into the chassis 102 (shown in FIG. 1), the second circuit card assembly 122 is inserted into the corresponding rack 108 (shown in FIG. 1). The rack 108 guides the second circuit card assembly 122 into the chassis 102. In an exemplary embodiment, the second circuit card assembly 122 is inserted into the rack 108 to a stop position, such as where the rack 108 retains the second circuit card assembly 122 in the rack 108. The stop position may not necessarily correspond to the mounted position of the first electrical connector 202. For example, due to manufacturing tolerances of the racks, the stop position may be at a position rearward of the ends of the grooves 256 such that fully inserting the second circuit card assembly 122 into the first slot 204 causes the pins 356 of the connecting elements 354 to travel beyond the resting points of the ends of the grooves 256. In an exemplary embodiment, the compliant section 286 of the first electrical connector 202 allows the mating housing 240 to move relative to the first PCB 200. As such, when the pins 356 bottom out at the ends of the grooves 256 and the second circuit card assembly 122 needs to move further to reach the stop position, the compliant section 286 allows the second circuit card assembly 122 to move to the stop position. The mating housing 240 moves with the second electrical connector 302 in the board mating direction until the second circuit card assembly 122 reaches the stop position. The flexible sections 290 of the contacts 228 allow the mating housing 240 to move with the second electrical connector 302.

In an exemplary embodiment, the first circuit card assembly 120 includes a return spring 384 that biases against the mating housing 240 to provide a spring force against the mating housing 240 in a direction opposite the board mating direction. The spring force may be overcome as the second circuit card assembly 122 is fully inserted to the stop position. When the second circuit card assembly 122 is removed from the communication system 100, the return spring 384 forces the mating housing 240 to return to the resting position (FIG. 14). The return spring 384 is shown mounted to the first PCB 200; however, the return spring 384 may be mounted elsewhere, such as to one or more of the contact modules 270.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A communication system comprising:

a first circuit card assembly having a first printed circuit board (PCB) and a first electrical connector, the first electrical connector having a first housing, the first PCB including a first slot extending rearward from a first mating edge of the first PCB, the first electrical connector being mounted to the first PCB along the first slot, the first electrical connector having a first mating end, the first electrical connector having first contacts held by the first housing and being provided at the first mating end, the first contacts being terminated to the first PCB; and a second circuit card assembly having a second PCB and a second electrical connector, the second electrical connector having a second housing extending from the second PCB, the second PCB having a second mating edge, the second electrical connector being mounted to the second PCB proximate to the mating edge, the second electrical connector having a second mating end, the second electrical connector having second contacts held by the second housing and being provided at the second mating end, the second contacts being terminated to the second PCB;

wherein the first and second circuit card assemblies are mated along a board mating axis parallel to the first slot with the first PCB oriented perpendicular to the second PCB, the first and second mating ends of the first and second electrical connectors being oriented parallel to the board mating axis, the second mating edge of the second PCB being received in the first slot to align the second mating end of the second electrical connector with the first mating end of the first electrical connector for mating the second electrical connector with the first electrical connector.

2. The communication system of claim 1, wherein the first PCB at least partially overlaps with the second PCB and the second PCB at least partially overlaps with the first PCB to align the first and second mating ends of the first and second electrical connectors.

3. The communication system of claim 1, wherein the first mating end is perpendicular to the first mating edge of the first PCB, the second mating end is perpendicular to the second mating edge of the second PCB.

4. The communication system of claim 1, wherein either the first PCB or the second PCB is oriented horizontally and the other of the first PCB or the second PCB is oriented vertically.

5. The communication system of claim 1, wherein the first slot is defined by a first side edge, a second side edge opposite the first side edge and an end edge between the first and second side edges remote from the first mating edge, the first and second side edges extending between the first mating edge and the end edge, the second PCB being received in the first slot such that the second mating edge faces the end edge of the first slot and first and second surfaces of the second PCB face the first and second side edges, respectively.

6. The communication system of claim 1, wherein the first and second electrical connectors are mated along a connector mating axis perpendicular to the board mating axis.

7. The communication system of claim 1, wherein the first mating end is oriented perpendicular to the first PCB, and wherein the second mating end is oriented parallel to the second PCB.

8. A circuit card assembly for a communication system comprising:

a printed circuit board (PCB) having a first surface and a second surface extending along a primary axis and a secondary axis, the PCB having a mating edge between the first and second surfaces generally parallel to the secondary axis, the PCB having a slot between the first and second surfaces, the slot open at the mating edge and extending a length generally along the primary axis, the PCB having a mounting area on the first surface adjacent the slot; and an electrical connector mounted to the first surface at the mounting area, the electrical connector having a front and a rear opposite the front, the front being provided proximate to the mating edge, the electrical connector having a mounting end extending between the front and the rear being mounted to the mounting area, the electrical connector including a mating housing, the mating housing of the electrical connector having a mating end extending between the front and the rear generally parallel to the primary axis, the mating end being movable relative to the PCB for mating to a mating electrical connector, the electrical connector having contacts including mating ends at the mating end of the mating housing being movable with the mating house and the contacts including terminating ends at the mounting end terminated to the PCB.

9. The circuit card assembly of claim 8, wherein the slot receives a PCB of a second circuit card assembly.

10. The circuit card assembly of claim 8, wherein the mating end of the mating housing of the electrical connector and the mating edge of the PCB are perpendicular to each other.

11. The circuit card assembly of claim 8, wherein the PCB is configured to be mated to a PCB of a second circuit card assembly in a board mating direction parallel to the primary axis, the mating end of the mating housing of the electrical connector being configured to be mated to the mating electrical connector in a connector mating direction parallel to the secondary axis.

12. The circuit card assembly of claim 8, wherein the front of the electrical connector is a first distance from the mating edge and the rear of the electrical connector is a second distance from the mating edge greater than the first distance, the mating end of the mating housing of the electrical connector spanning a majority of the distance between the front and the rear.

13. The circuit card assembly of claim 8, wherein the mating housing holding the mating ends of the contacts, the electrical connector including contact modules coupled to the mating housing, the contact modules holding the terminating ends of the contacts for mounting to the PCB.

14. The circuit card assembly of claim 13, wherein the contacts include flexible sections between the mating ends and the terminating ends, the flexible sections allowing relative movement between the mating ends and the terminating ends.

15. The circuit card assembly of claim 8, wherein the electrical connector includes a compliant section allowing the mating ends of the contacts to shift rearward relative to the PCB parallel to the primary axis when mating to the mating electrical connector.

16. A communication system comprising:

a first circuit card assembly having a first printed circuit board (PCB) and a first electrical connector mounted to the first PCB, the first PCB having a first surface and a second surface extending along a primary axis and a secondary axis, the first PCB having a first mating edge between the first and second surfaces generally parallel to the secondary axis of the first PCB, the first PCB having a first slot between the first and second surfaces open at the first mating edge and extending a length generally along the primary axis of the first PCB, the first PCB having a first mounting area on the first surface adjacent the first slot with the first electrical connector mounted to the first mounting area, the first electrical connector having a front and a rear opposite the front, a mounting end extending between the front and the rear being mounted to the mounting area, and a mating end extending between the front and the rear generally parallel to the primary axis of the first PCB, the first electrical connector having first contacts including mating ends at the mating end of the first electrical connector and terminating ends at the mounting end of the first electrical connector terminated to the first PCB; and a second circuit card assembly having a second PCB and a second electrical connector mounted to the second PCB, the second PCB having a first surface and a second surface extending along a primary axis and a secondary axis, the second PCB having a second mating edge between the first and second surfaces generally parallel to the secondary axis of the second PCB, the second PCB having a second mounting area on the first surface proximate to the second mating edge with the second electrical connector mounted to the second mounting area, the second electrical connector having a front and a rear opposite the front, a mounting end extending between the front and the rear being mounted to the mounting area, and a mating end extending between the front and the rear generally parallel to the primary axis of the second PCB, the second electrical connector having second contacts including mating ends at the mating end of the second electrical connector and terminating ends at the mounting end of the second electrical connector terminated to the second PCB;

wherein the second mating edge of the second PCB is received in the first slot to align the mating end of the second electrical connector with the mating end of the first electrical connector.

17. The communication system of claim 16, wherein the second PCB has a second slot between the first and second surfaces open at the second mating edge and extending a length along the primary axis of the second PCB, the second slot receiving the first mating edge of the first PCB to align the mating end of the second electrical connector with the mating end of the first electrical connector.

18. The communication system of claim 16, further comprising a chassis having a frame including a first rack holding the first circuit card assembly, the frame having a second rack configured to receive the second circuit card assembly in a loading direction parallel to the primary axis of the second circuit card assembly, the second mating edge being received in the first slot as the second circuit card assembly is inserted into the second rack in the loading direction.

19. The communication system of claim 16, wherein the first PCB includes an additional slot open at the first mating end and being spaced apart from the first slot, the first PCB includes an additional electrical connector mounted to the first PCB adjacent to the additional slot, the additional slot receiving a third circuit card assembly having a third PCB oriented parallel to the second PCB and a third electrical connector mounted to the third PCB being mated to the additional electrical connector.

20. The communication system of claim 16, wherein the first circuit card assembly includes a third electrical connector mounted to the first PCB adjacent the first slot, the second circuit card assembly having a fourth electrical connector mounted to the second PCB, the fourth electrical connector being mated to the third electrical connector when the second PCB is received in the first slot.

21. The communication system of claim 16, wherein the first PCB at least partially overlaps with the second PCB and the second PCB at least partially overlaps with the first PCB to align the first and second mating ends of the first and second electrical connectors.

22. The communication system of claim 16, wherein the first mating end is perpendicular to the first mating edge of the first PCB, the second mating end is perpendicular to the second mating edge of the second PCB.

23. The communication system of claim 16, wherein either the first PCB or the second PCB is oriented horizontally and the other of the first PCB or the second PCB is oriented vertically.

24. The communication system of claim 16, wherein the first slot is defined by a first side edge, a second side edge opposite the first side edge and an end edge between the first and second side edges remote from the first mating edge, the first and second side edges extending between the first mating edge and the end edge, the second PCB being received in the first slot such that the second mating edge faces the end edge of the first slot and first and second surfaces of the second PCB face the first and second side edges, respectively.

25. The communication system of claim 16, wherein the first and second electrical connectors are mated along a connector mating axis perpendicular to the board mating axis.

26. The communication system of claim 16, wherein the first mating end is oriented perpendicular to the first PCB, and wherein the second mating end is oriented parallel to the second PCB.

27. The communication system of claim 16, wherein the first PCB is mated to the second PCB in a board mating direction parallel to the primary axis, the mating end of the first electrical connector being mated to the second electrical connector in a connector mating direction parallel to the secondary axis.

28. The communication system of claim 16, wherein the first electrical connector includes a mating housing holding the mating ends of the first contacts, the first electrical connector including contact modules coupled to the mating housing, the contact modules holding the terminating ends of the contacts for mounting to the PCB.

29. The communication system of claim 16, wherein the first contacts include flexible sections between the mating ends and the terminating ends, the flexible sections allowing relative movement between the mating ends and the terminating ends.

30. The communication system of claim 16, wherein the first electrical connector includes a compliant section allowing the mating ends of the first contacts to shift rearward relative to the first PCB parallel to the primary axis when mating to the second electrical connector.

* * * * *